US011677177B2

(12) United States Patent
Aoshima

(10) Patent No.: US 11,677,177 B2
(45) Date of Patent: Jun. 13, 2023

(54) WATERPROOF CONNECTOR WITH PACKING AND RETAINER

(71) Applicant: Yazaki Corporation, Tokyo (JP)

(72) Inventor: Kengo Aoshima, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/387,557

(22) Filed: Jul. 28, 2021

(65) Prior Publication Data

US 2022/0037830 A1 Feb. 3, 2022

(30) Foreign Application Priority Data

Jul. 29, 2020 (JP) ..... JP2020-128587

(51) Int. Cl.
*H01R 13/52* (2006.01)
*H01R 13/422* (2006.01)

(52) U.S. Cl.
CPC ..... *H01R 13/5205* (2013.01); *H01R 13/4223* (2013.01); *H01R 2201/26* (2013.01)

(58) Field of Classification Search
CPC ..... H01R 13/5202; H01R 13/5205; H01R 13/4223
USPC ..... 439/587, 588
See application file for complete search history.

(56) References Cited

U.S. PATENT DOCUMENTS 8,562,377 B2 * 10/2013 Kawamura ..... H01R 13/5205 439/607.44
8,992,242 B2 * 3/2015 Casses ..... H01R 13/5205 439/271
9,887,486 B2 * 2/2018 Okamoto ..... H01R 13/5205
9,929,491 B2 * 3/2018 Yamaguchi ..... H01R 11/12
10,050,376 B2 * 8/2018 Suzuki ..... H01R 13/5216
10,224,666 B2 * 3/2019 Aoshima ..... H01R 13/5202
2005/0245130 A1 * 11/2005 Shiga ..... H01R 13/5208 439/587
2015/0044895 A1 * 2/2015 Aizawa ..... H01R 13/6598 439/278
2015/0140850 A1 * 5/2015 Suzuki ..... H01R 13/5219 439/275
2015/0244100 A1 * 8/2015 Kashiwada ..... H01R 13/5219 439/556
2016/0006163 A1 * 1/2016 Tashiro ..... H01R 13/5216 439/587

(Continued)

FOREIGN PATENT DOCUMENTS

EP 3691046 A1 * 8/2020 ..... B60R 16/0207
FR 3013156 A1 * 5/2015 ..... H01R 13/5202

(Continued)

*Primary Examiner* — Marcus E Harcum
(74) *Attorney, Agent, or Firm* — Sughrue Mion, PLLC

(57) ABSTRACT

A waterproof connector includes a housing having a fitting portion to be fitted into a mounting hole of a mating member. A packing mounting surface is provided on an outer peripheral surface of the fitting portion. The waterproof connector further includes a first packing mounted on a rear end side of the packing mounting surface in a fitting direction of the fitting portion, a second packing mounted on a front end side of the packing mounting surface in the fitting direction of the fitting portion, and a retainer provided between the first packing and the second packing and locked to a locking portion provided on the outer peripheral surface of the fitting portion.

6 Claims, 10 Drawing Sheets

(56) References Cited

U.S. PATENT DOCUMENTS

| | | | | |
|---|---|---|---|---|
| 2018/0006523 | A1* | 1/2018 | Ishibashi | H02K 5/225 |
| 2018/0076561 | A1* | 3/2018 | Aoshima | H01R 13/40 |
| 2018/0183169 | A1* | 6/2018 | Yamanaka | H01R 13/4367 |
| 2018/0351304 | A1* | 12/2018 | Miyazawa | H01R 13/6596 |
| 2018/0358737 | A1* | 12/2018 | Endo | H01R 13/5202 |
| 2019/0103716 | A1* | 4/2019 | Yamazaki | H01R 13/6596 |
| 2019/0123479 | A1 | 4/2019 | Lim et al. | |
| 2020/0313344 | A1* | 10/2020 | Araki | H01R 13/6596 |
| 2021/0313746 | A1* | 10/2021 | Kato | H04N 5/2251 |

FOREIGN PATENT DOCUMENTS

| | | | | |
|---|---|---|---|---|
| JP | 2019-79800 | A | | 5/2019 |
| JP | 2021136131 | A | * | 9/2021 |

* cited by examiner

WATERPROOF CONNECTOR WITH PACKING AND RETAINER

CROSS-REFERENCE TO RELATED APPLICATIONS

This application is based on and claims priority under 35 USC 119 from Japanese Patent Application No. 2020-128587 filed on Jul. 29, 2020, the contents of which are incorporated herein by reference.

TECHNICAL FIELD

The present disclosure relates to a waterproof connector.

BACKGROUND ART

A connector (waterproof connector) with improved waterproofness is known (see, for example, JP-A-2019-79800). This connector watertightly seals a portion between a mounting hole of a module of a mating member into which a housing is fitted and the housing by two O-rings (packings) provided on an outer peripheral surface of the housing. These two O-rings are supported respectively by a pair of annular grooves (packing accommodation grooves) formed along the outer peripheral surface of the housing and are arranged side by side along a fitting direction of the housing.

Therefore, the two O-rings arranged side by side on the outer peripheral surface along the fitting direction of the housing can more reliably seal a portion between the mounting hole and the housing in a watertight manner than in the case of one O-ring.

However, when two packings are respectively mounted in a pair of packing accommodation grooves arranged side by side along the fitting direction of the housing, the packing on a back side needs to be expanded and mounted in order to ride over a wall formed between the pair of packing accommodation grooves, and thus mounting workability is not good. Then, the packing may be twisted at the time of mounting, or a sealing portion of the packing may be scratched, thereby resulting in deterioration of sealing performance. Further, when the packing and the packing accommodation groove are not annular, the packing may be misaligned during mounting and the sealing performance may be deteriorated.

SUMMARY OF INVENTION

The present disclosure is made in view of the circumstances described above and an object of the invention is to provide a waterproof connector in which it is easy to mount a packing and which has high waterproofness.

The above-described object according to the present disclosure is achieved by the following configuration.

According to an aspect of the present disclosure, there is provided a waterproof connector, including:

a housing having a fitting portion to be fitted into a mounting hole of a mating member, in which a packing mounting surface is provided on an outer peripheral surface of the fitting portion;

a first packing mounted on a rear end side of the packing mounting surface in a fitting direction of the fitting portion;

a second packing mounted on a front end side of the packing mounting surface in the fitting direction of the fitting portion; and a retainer provided between the first packing and the second packing and locked to a locking portion provided on the outer peripheral surface of the fitting portion.

According to the waterproof connector of the above configuration, the waterproof connector in which it is easy to mount the packing and which has high waterproofness can be obtained.

The present disclosure is briefly described above. Further, the details of the present disclosure will be further clarified by reading through the description of embodiment (hereinafter referred to as "embodiment") described below with reference to the accompanying drawings.

DESCRIPTION OF EMBODIMENT

Hereinafter, an embodiment according to the present disclosure will be described with reference to the drawings.

Figure 1:
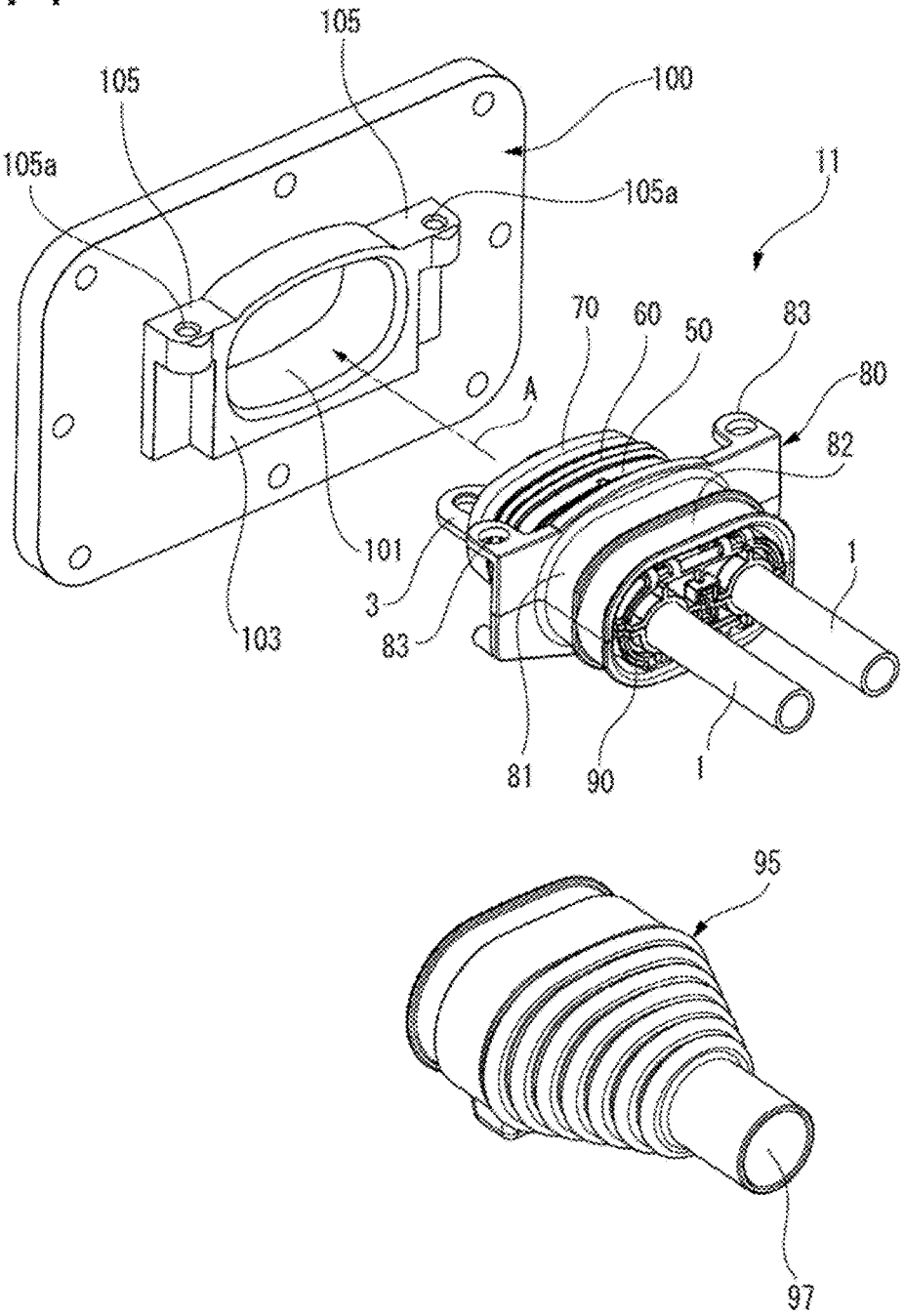
FIG. 1 is a perspective view illustrating a state before a waterproof connector according to an embodiment of the present disclosure is fitted into a mounting hole of a mating member.
Figure 2:
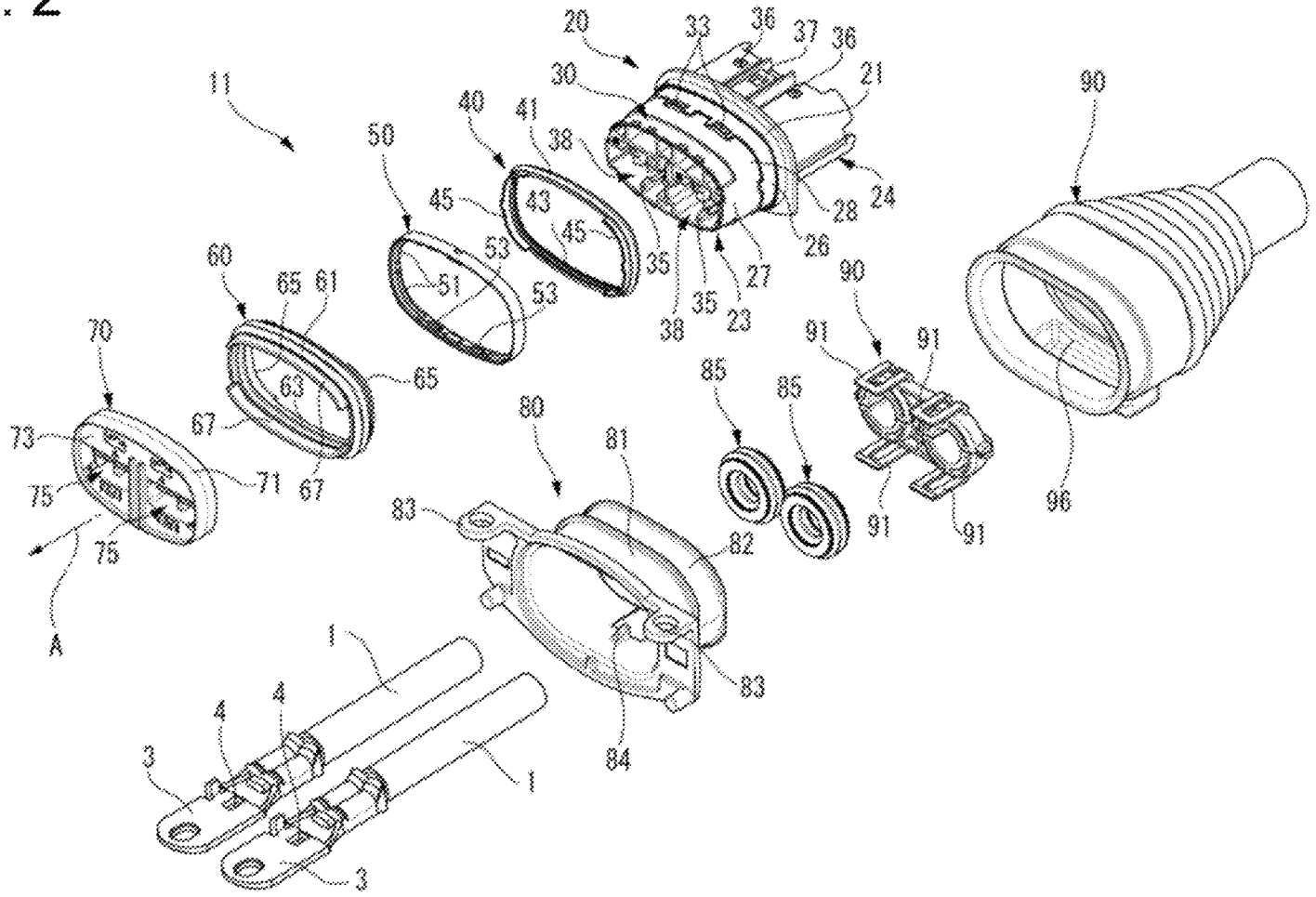
FIG. 2 is an exploded perspective view of the waterproof connector illustrated in FIG. 1.

FIG. 1 is a perspective view illustrating a state before a waterproof connector 11 according to an embodiment of the present disclosure is fitted into a mounting hole 101 of a case body 100 which is a mating member. FIG. 2 is an exploded perspective view of the waterproof connector 11 illustrated in FIG. 1.

The waterproof connector 11 according to the present embodiment is, for example, a waterproof connector used for directly attaching to a device when an inverter, a motor, and the like, which are vehicle-mounted electric devices (hereafter, it is simply referred to as "devices") of an electric vehicle or a hybrid vehicle, are electrically connected. Motors mounted on hybrid vehicles or electric vehicles are supplied with a large current from an inverter or the like to exert high drive torque. Normally, in order to reduce transmission loss, for an electric wire 1 connecting the inverter and the motor, a large-diameter electric wire (thick electric wire) having a large conductor diameter and a circumference of the conductor covered with an insulating coating having high insulating performance is used. The waterproof connector 11 is suitable for use in a structure in which such a large-diameter electric wire 1 is directly attached to the mounting hole 101 provided in the case body 100 of the device.

In the present embodiment, a fitting direction A of the waterproof connector 11 with respect to the mounting hole 101 is the front of the connector, and a removal direction is the rear of the connector.

As illustrated in FIGS. 1 and 2, the waterproof connector 11 according to the present embodiment includes a housing 20, a first packing 40, a retainer 50, a second packing 60, and a front holder 70 as main configurations. In addition, the waterproof connector 11 includes a terminal 3 connected to an end portion of the electric wire 1, a shield shell 80, a rubber stopper 85, a pair of upper and lower rear holders 90, and a waterproof boot 95.

The case body 100 can be, for example, a case body (metal case, or the like) of an inverter mounted on an electric vehicle, a hybrid vehicle, or the like. The case body 100 is a case body as a mating member made of a conductive metal having a connector mounting surface 103 and a bolt fixing surface 105 which are substantially orthogonal to each other.

The mating member in the present disclosure is not limited to the case body and can be applied to various mating members such as a mating connector to which a waterproof connector is fitted.

Figure 3A:
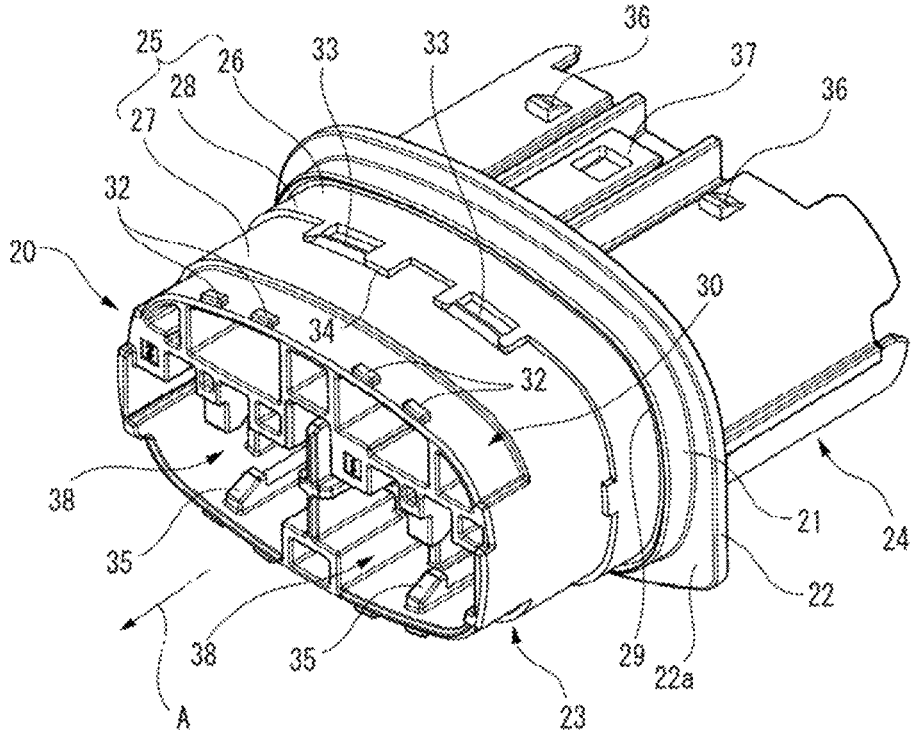
FIGS. 3A and 3B are an enlarged perspective view and a plan view of a housing illustrated in FIG. 2.
Figure 3B:
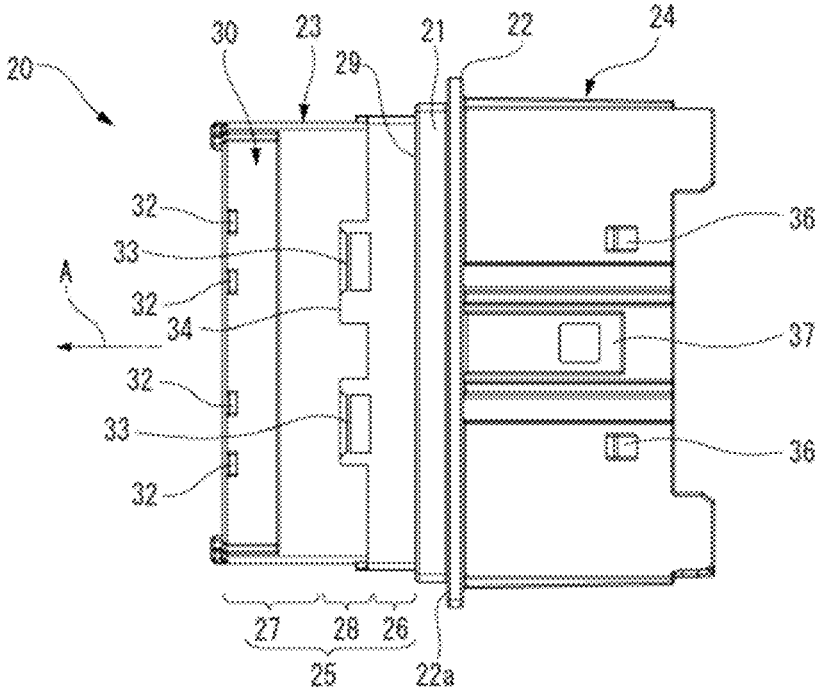

FIGS. 3A and 3B are an enlarged perspective view and an enlarged plan view of the housing 20 illustrated in FIG. 2.

The housing 20 is made of an electrically insulating synthetic resin and is formed in an elliptic cylindrical shape. As illustrated in FIGS. 3A and 3B, the housing 20 includes a flange portion 22 protruding from an outer peripheral surface 21 of a substantially intermediate portion in the fitting direction A, a fitting portion 23 provided in front of the flange portion 22 and fitted into the mounting hole 101 of the case body 100, and a mounting portion 24 provided behind the flange portion 22 and in which the shield shell 80 is mounted.

A front side surface 22*a* orthogonal to the fitting direction A abuts on the connector mounting surface 103 of the case body 100, whereby the flange portion 22 regulates an insertion position of the housing 20 of which the fitting portion 23 is fitted into the mounting hole 101 of the case body 100.

A packing mounting surface 25 is provided on an outer peripheral surface of the fitting portion 23. The packing mounting surface 25 includes a first packing mounting surface 26 which is a packing mounting surface for the first packing 40 on a rear end side of the fitting portion 23 in the fitting direction, a second packing mounting surface 27 which is a packing mounting surface for the second packing 60 on a front end side of the fitting portion in the fitting direction, and a retainer mounting portion 28 which is an outer peripheral surface of the fitting portion 23 between the first packing mounting surface 26 and the second packing mounting surface 27.

The first packing mounting surface 26 on which the first packing 40 is mounted is located on an inner side of the housing from the outer peripheral surface 21 of the fitting portion 23, and a step portion 29 is formed between the outer peripheral surface 21 of the fitting portion 23 and the first packing mounting surface 26.

The annular retainer mounting portion 28 to which the retainer 50 is attached is continuously provided on the first packing mounting surface 26. Locking portions 33 for locking the retainer 50 are formed respectively on upper and lower surfaces (surfaces in an up-down direction in FIG. 3A) of the retainer mounting portion 28. The locking portion 33 is composed of a ridge which protrudes from the retainer mounting portion 28 and extends in the circumferential direction.

The second packing mounting surface 27 on which the second packing 60 is mounted is located on an inner side of the housing from the first packing mounting surface 26 on which the first packing 40 is mounted. Therefore, a step portion 34 is formed between the second packing mounting surface 27 on which the second packing 60 is mounted and the first packing mounting surface 27 on which the first packing 40 is mounted.

A recess 30 having a strip-shaped outer shape along the circumferential direction is provided on a front end side of the second packing mounting surface 27 in the fitting direction. The recesses 30 are provided respectively on the upper and lower surfaces (surfaces in the up-down direction in FIG. 3A) of the second packing mounting surface 27. A step portion 31 is formed between the second packing mounting surface 27 and the recess 30. A plurality of locking portions 32 protrude along the circumferential direction at front end edges of the recess 30 in the fitting direction.

On the upper and lower surfaces (surfaces in the up-down direction in FIG. 3A) of an outer peripheral surface of the mounting portion 24, locking arms 37 which lock locking protrusions 84 protruding from an inner peripheral surface of the shield shell 80 to hold the shield shell 80, and locking protrusions 36 which lock locking arms 91 of the rear holder 90 to hold the rear holder 90 are provided respectively.

A plurality of (two in the present embodiment) terminal accommodation chambers 38 are formed inside the housing 20. The terminal accommodation chamber 38 is fitted with the terminal 3 connected to an end portion of the electric wire 1. The terminal 3 is inserted into the terminal accommodation chamber 38 from the rear of the housing 20 and protrudes in front of the housing 20. The electric wire 1 is derived from the rear of the housing 20. The terminal 3 inserted into the terminal accommodation chamber 38 has a locking hole 4 locked by a flexible locking arm 39 (see FIG. 9) provided in the terminal accommodation chamber 38 and is prevented from coming off from the terminal accommodation chamber 38.

On an inner peripheral surface of a front opening portion of the housing 20, a locking protrusion 35 for locking a locking arm 77 of the front holder 70, which will be described below, is protruded to hold the front holder 70.

The shield shell 80 is made of a conductive metal. As illustrated in FIG. 2, the shield shell 80 integrally covers the outer peripheral surface of the mounting portion 24 in the housing 20 by a tubular shell body 81. The shield shell 80 is fixed to the housing 20 by locking the locking protrusion 84 protruding from the inner peripheral surface to the locking arm 37 provided on the mounting portion 24. The shield shell 80 is formed with a pair of bolt fixing portions 83 fixed to the bolt fixing surface 105 of the case body 100. In the present embodiment, the bolt fixing portion 83 is formed by drilling a bolt insertion hole in an L-shaped bent piece extending from the shell body.

A braided wire (not illustrated) covering the two electric wires 1 is connected to a braided fixing portion 82 of the shell body 81 by a shield ring or the like, and then the shield shell 80 is fastened to the case body 100 by bolts. As a result, the shield shell 80 forms a shielded circuit and has a structure which shields noise. The housing 20 is bolt-fastened to the case body 100 via the shield shell 80.

The bolt fixing surface 105 of the case body 100 is formed with a pair of bolt holes 105*a* (see FIG. 1) to which the bolt fixing portions 83 are bolt-fastened.

The rubber stopper 85 is formed in an annular shape by an elastic material such as rubber. As illustrated in FIG. 2, the rubber stopper 85 has the electric wire 1 inserted inward. An outer circumference of the rubber stopper 85 is in close contact with an inner wall surface of a rear end opening 38*a* (see FIGS. 6A and 6B) of the terminal accommodation chamber 38 in the housing 20. As a result, the rubber stopper 85 provides a waterproof seal between the housing 20 and the electric wire 1.

The rear holder 90 is attached to the rear end opening 38*a* of the housing 20. The rear holder 90 suppresses bending of the electric wire 1 by locking the locking arm 91 to the locking protrusion 36 of the mounting portion 24 and attaching rear holder 90 to the housing 20. The rear holder 90 prevents the rubber stopper 85 from coming off or falling in the housing 20.

The waterproof boot 95 is made of an elastic material such as silicone, rubber, or soft resin. In the waterproof boot 95, a front end opening portion 96 is mounted on the shell body 81 of the shield shell 80 and covers a fixed portion between the shield shell 80 and the braided terminal to make it waterproof. The electric wire 1 inserted through the waterproof boot 95 is derived from a rear end opening 97 of the waterproof boot 95.

Figure 4:
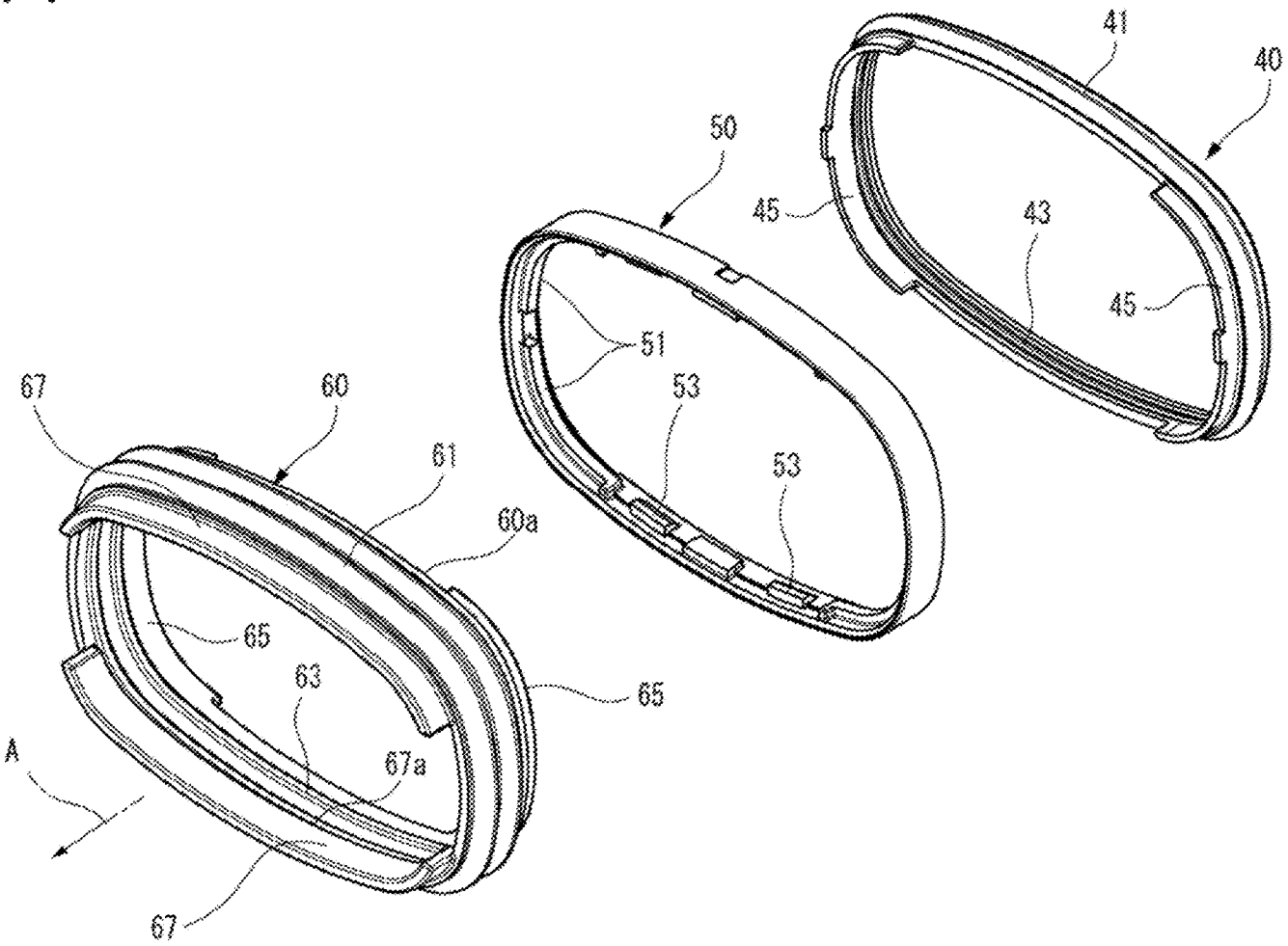
FIG. 4 is an enlarged perspective view of a first packing, a retainer, and a second packing illustrated in FIG. 2.

FIG. 4 is an enlarged perspective view of the first packing 40, the retainer 50, and the second packing 60 illustrated in FIG. 2.

The first packing 40 is formed in an oval ring shape by an elastic material such as rubber. The first packing 40 is attached to the first packing mounting surface 26 in the fitting portion 23 of the housing 20 and provides a waterproof seal between the fitting portion 23 of the housing 20 and the mounting hole 101 of the case body 100.

On an outer peripheral surface of the first packing 40, an outer lip 41 which is in close contact with the inner peripheral surface of the mounting hole 101 is provided. Further, on an inner peripheral surface of the first packing 40, an inner lip 43 which is in close contact with the first packing mounting surface 26 of the fitting portion 23 is provided.

A pair of engaging protrusion pieces 45 protruding toward the fitting direction A are provided on the front end side of the first packing 40 in the fitting direction. The engaging protrusion pieces 45 respectively extend in a substantially C shape along a left and right lateral direction (up-down direction).

The retainer 50 is made of an electrically insulating synthetic resin and is formed in an oval ring shape. The retainer 50 is attached to the retainer mounting portion 28 in the fining portion 23 of the housing 20.

On an inner peripheral surface of the retainer 50, a locking protrusion 53 which is locked to the locking portion 33 provided on the outer peripheral surface of the fitting portion 23 and a plurality of support ribs 51 extending along a circumferential direction so as to abut on the outer peripheral surface of the retainer mounting portion 28 are provided.

The support rib 51 protrudes from an inner peripheral surface of a substantially intermediate portion of the retainer 50 in the fitting direction A. Therefore, when the retainer 50 is attached to the retainer mounting portion 28, gaps are defined between the inner peripheral surfaces of the retainer 50 at front and rear of the support rib 51 in the fitting direction A with the support rib 51 interposed therebetween and the outer peripheral surface of the retainer mounting portion 28.

The engaging protrusion piece 45 of the first packing 40 is inserted into the gap on the rear side of the support rib 51 and an engaging protrusion piece 65 of the second packing 60, which will be described below, is inserted into the gap on the front side of the support rib 51.

The second packing 60 is formed in an oval ring shape by an elastic material such as rubber. The second packing 60 is attached to the second packing mounting surface 27 in the fitting portion 23 of the housing 20 and provides a waterproof seal between the fitting portion 23 of the housing 20 and the mounting hole 101 of the case body 100.

On the outer peripheral surface of the second packing 60, an outer lip 61 which is in close contact with the inner peripheral surface of the mounting hole 101 is provided. Further, on the inner peripheral surface of the second packing 60, an inner lip 63 which is in close contact with the second packing mounting surface 27 of the fitting portion 23 is provided.

On a rear end side of the second packing 60 in the fitting direction, a pair of engaging protrusion pieces 65 protruding toward the removal direction opposite to the fitting direction A are provided. The engaging protrusion pieces 65 respectively extend in a substantially C shape along the left and right lateral direction (up-down direction).

A pair of engaging pieces 67 protruding toward the fitting direction A are provided on the front end side of the second packing 60 in the fitting direction. The engaging pieces 67 respectively extend in a substantially C shape along an up and down longitudinal direction (left-right direction). The engaging piece 67 of the second packing 60 has an outer shape corresponding to a strip-shaped outer shape of the recess 30 formed on the second packing mounting surface 27 and can be complementarily engaged with the recess 30.

Further, the engaging piece 67 of the second packing 60 is covered by the rear end portion of the front holder 70 in the fitting direction, which will be described below, as at least a part of an outer peripheral portion of the second packing 60 on the front end side in the fitting direction.

Figure 5A:
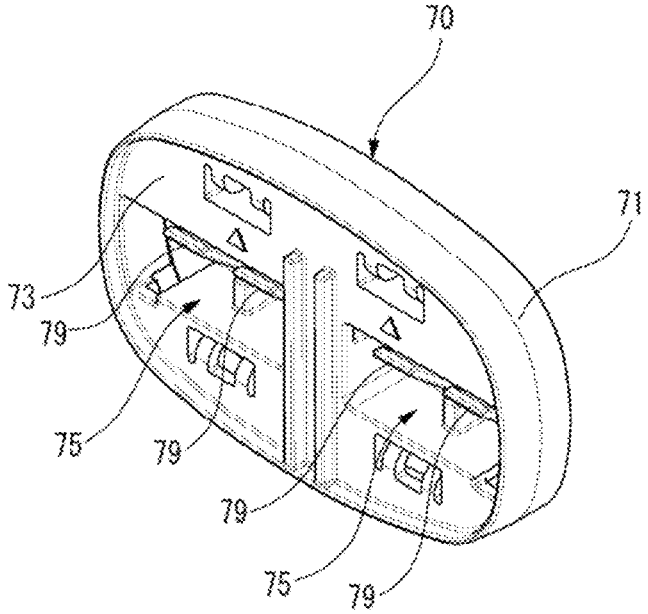
FIGS. 5A and 5B are a perspective view of the front holder illustrated in FIG. 2 as viewed from the front and a perspective view as viewed from the rear.
Figure 5B:
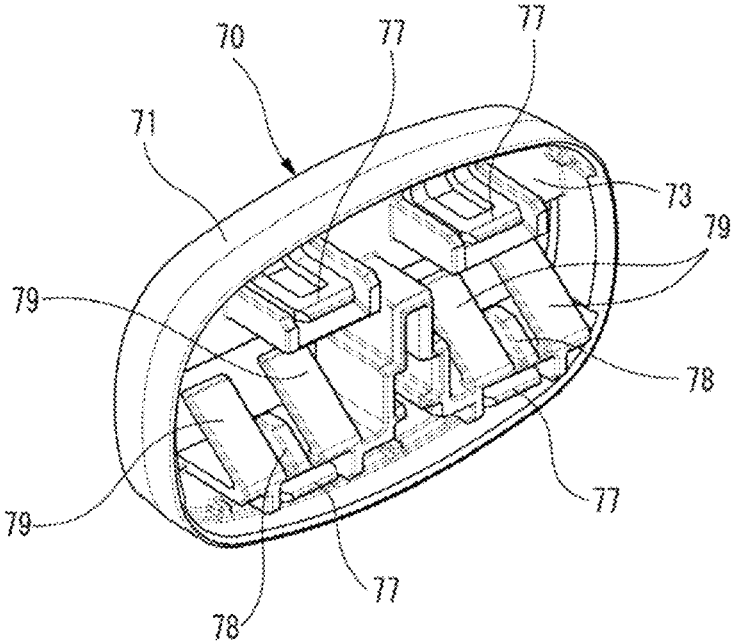

FIGS. 5A and 5B are a perspective view of the front holder 70 illustrated in FIG. 2 as viewed from the front and a perspective view as viewed from the rear.

The front holder 70 is made of an electrically insulating synthetic resin and is attached to a front end portion of the housing 20. As illustrated in FIG. 5A, the front holder 70 has an annular portion 71 having an annular shape and a front wall portion 73 having an oval disk shape.

The front wall portion 73 is formed with a terminal insertion port 75 through which the terminal 3 is inserted. On the front end side of the front wall portion 73 in the fitting direction, as illustrated in FIG. 5B, a plurality of (four in the present embodiment) locking arms 77 locked to the locking protrusions 35 of the housing 20, a pair of engaging protrusions 78 which engage with the locking hole 4 of the terminal 3 and double-lock the terminal 3, and a plurality of (four in this embodiment) flexible pieces 79 which is elastically in contact with the terminal 3 to suppress rattling of the terminal 3 are provided.

The front holder 70 is attached to the front end portion of the housing 20 to regulate the detachment of the second packing 60. Further, the rear end portion of the annular portion 71 in the front holder 70 in the fitting direction can cover the engaging piece 67 of the second packing 60.

The front holder 70 can position the terminal 3 inserted into the terminal insertion port 75.

Next, the procedure for attaching the first packing 40 and the second packing 60 to the fitting portion 23 of the housing 20 will be described.

Figure 6A:
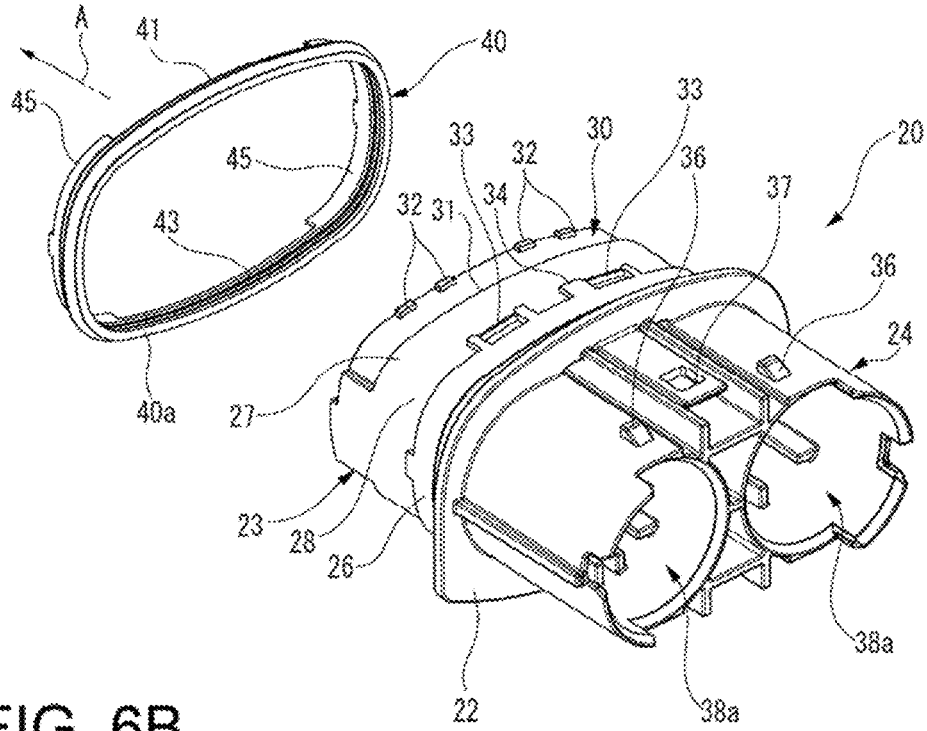
FIGS. 6A and 6B are perspective views for illustrating a mounting operation of the first packing illustrated in FIG. 2.
Figure 6B:
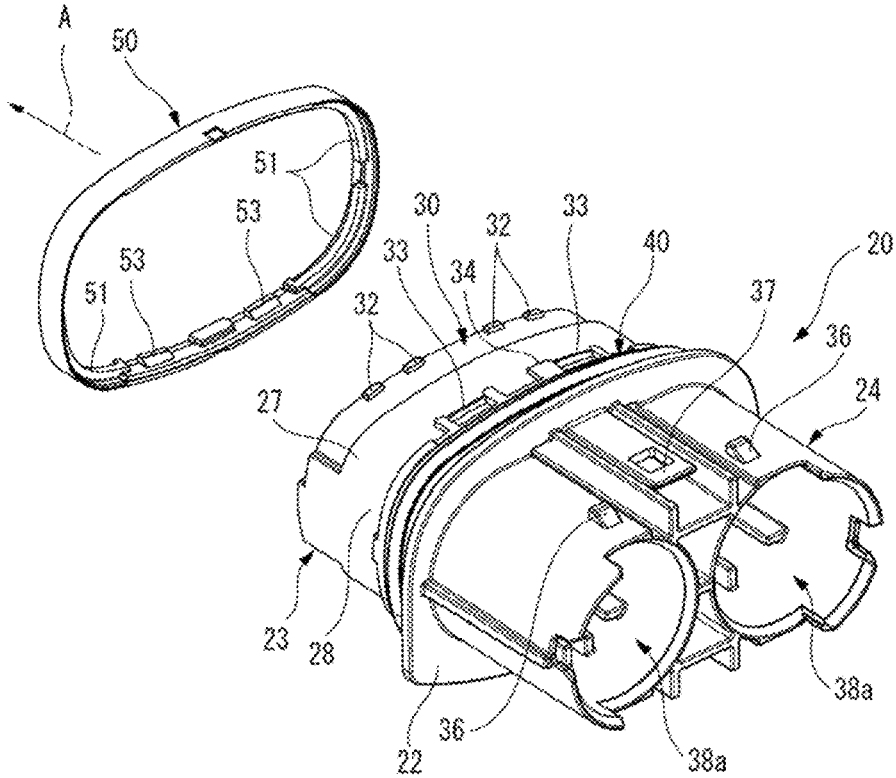

FIGS. 6A and 6B are perspective views for illustrating the mounting operation of the first packing 40 illustrated in FIG.

Figure 7A:
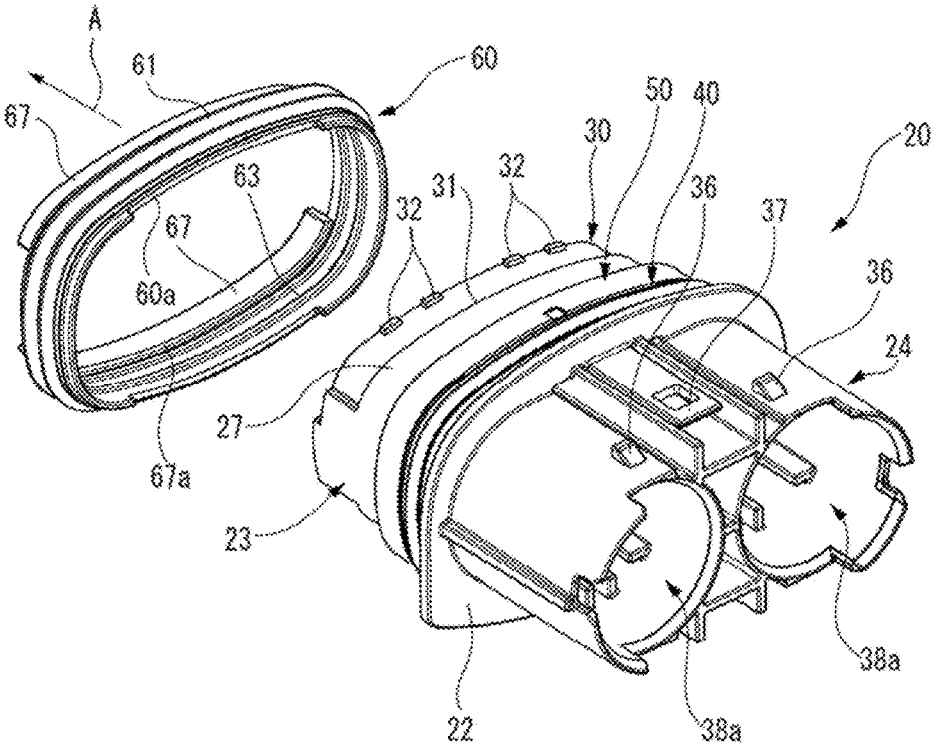
FIGS. 7A and 7B are perspective views for illustrating a mounting operation of the second packing illustrated in FIG. 2.
Figure 7B:
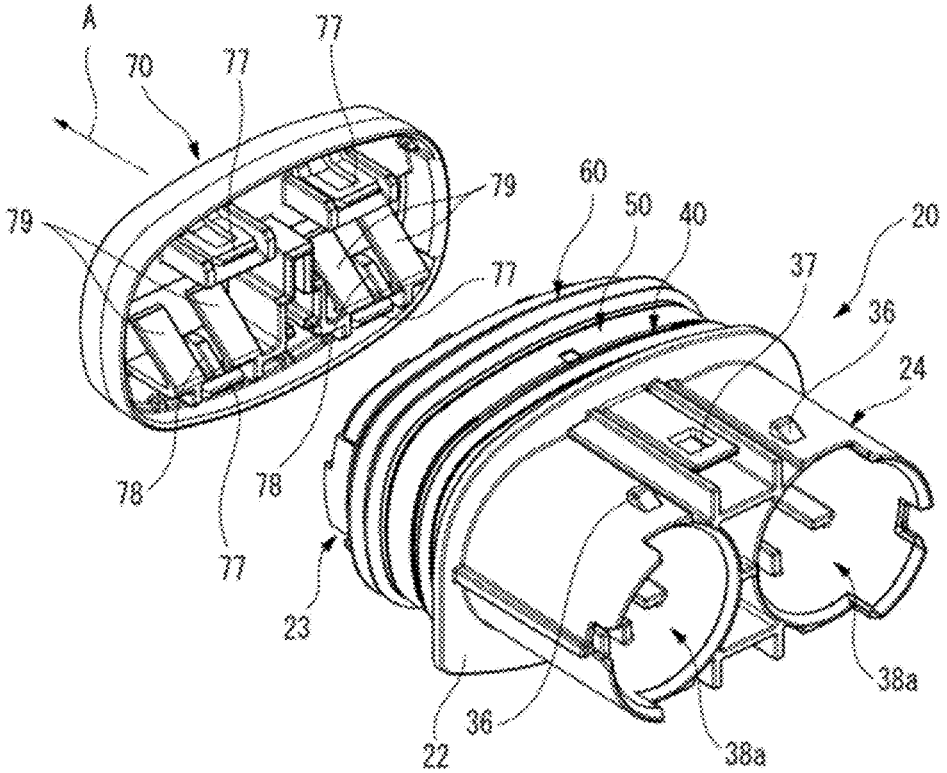

2. FIGS. 7A and 7B are perspective views for illustrating the mounting operation of the second packing 60 illustrated in FIG. 2.

First, as illustrated in FIGS. 6A and 6B, the first packing 40 is mounted on the first packing mounting surface 26 in the fitting portion 23 of the housing 20. The first packing 40 fitted in the fitting portion 23 of housing 20 is moved until a fitting direction rear end 40*a* abuts on the step portion 29 formed between the outer peripheral surface 21 of the fitting portion 23 and the first packing mounting surface 26.

Next, the retainer 50 is mounted in the retainer mounting portion 28 in the fitting portion 23 of the housing 20. The retainer 50 fitted in the fitting portion 23 of the housing 20 is moved until the locking protrusion 53 is locked to the locking portion 33 of the retainer mounting portion 28. The retainer 50 mounted in the retainer mounting portion 28 is held in the retainer mounting portion 28 by locking the locking protrusion 53 to the locking portion 33.

The engaging protrusion piece 45 of the first packing 40 is inserted into the gap defined between the outer peripheral surface of the retainer mounting portion 28 and the inner peripheral surface of the retainer 50 and the outer peripheral surface thereof is covered by the retainer 50. Therefore, the retainer 50 restricts the movement of the first packing 40 in the fitting direction A and prevents the first packing 40 from turning over on the front end portion in the fitting direction.

Next, the second packing 60 is mounted on the second packing mounting surface 27 in the fitting portion 23 of the housing 20. The second packing 60 fitted in the fitting portion 23 of the housing 20 is moved until a fitting direction rear end 60*a* abuts on the step portion 34, or until a fitting direction rear end 67*a* of the engaging piece 67 abuts on the step portion 31. The second packing 60 mounted on the second packing mounting surface 27 is held on the second packing mounting surface 27 by complementarily engaging the engaging piece 67 with the recess 30 and locking the engaging piece 67 to the locking portion 32.

The engaging protrusion piece 65 of the second packing 60 is inserted into the gap defined between the second packing mounting surface 27 and the inner peripheral surface of the retainer 50 and the outer peripheral surface thereof is covered by the retainer 50. Therefore, the retainer 50 prevents the second packing 60 from turning over on the rear end side in the fitting direction.

Finally, the front holder 70 is attached to the front end portion of the housing 20. The front holder 70 attached to the front end portion of the housing 20 is moved until the locking arm 77 is locked to the locking protrusion 35 of the housing 20. The front holder 70 attached to the front end portion of the housing 20 is held in the front end portion of the housing 20 by locking the locking arm 77 to the locking protrusion 35.

The outer peripheral surface of the engaging piece 67 of the second packing 60 is covered by the rear end side of the front holder 70 in the fitting direction. Therefore, the front holder 70 prevents the second packing 60 from turning over on the front end side in the fitting direction.

Next, an operation of the waterproof connector 11 having the configuration described above will be described.

Figure 8:
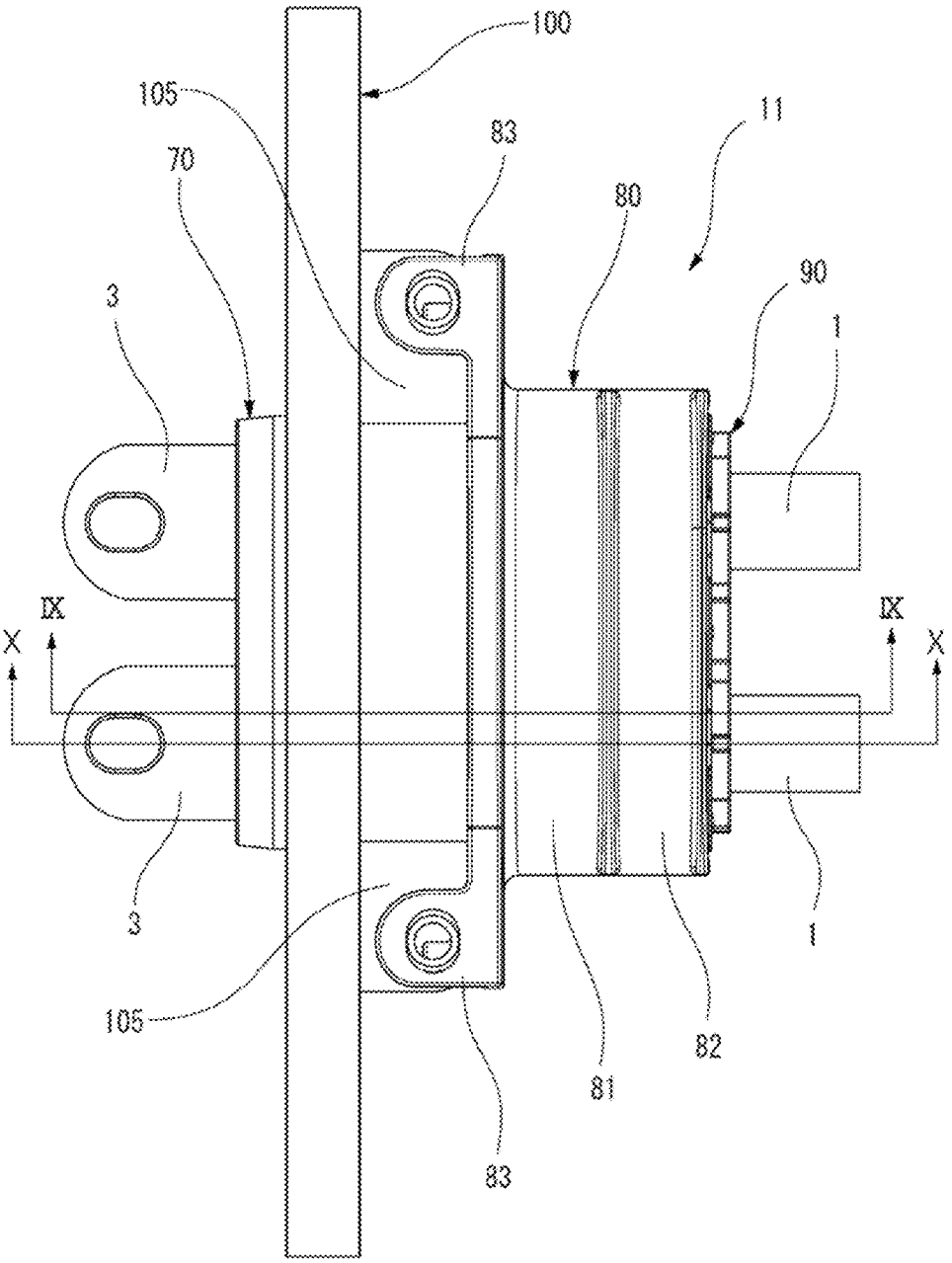
FIG. 8 is a plan view of the waterproof connector illustrated in FIG. 1.
Figure 9:
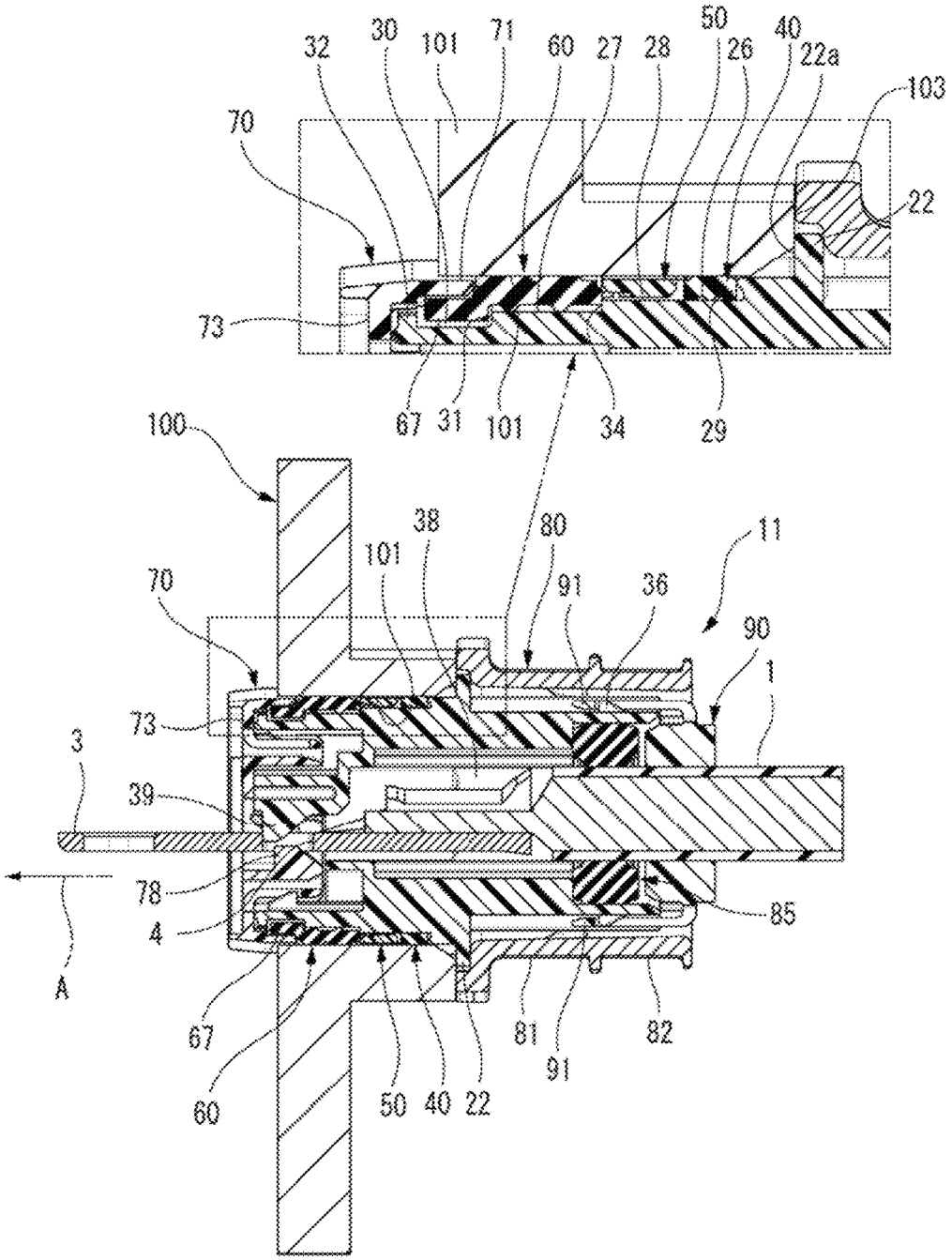
FIG. 9 is a cross-sectional arrow view taken along the line IX-IX in FIG. 8.
Figure 10:
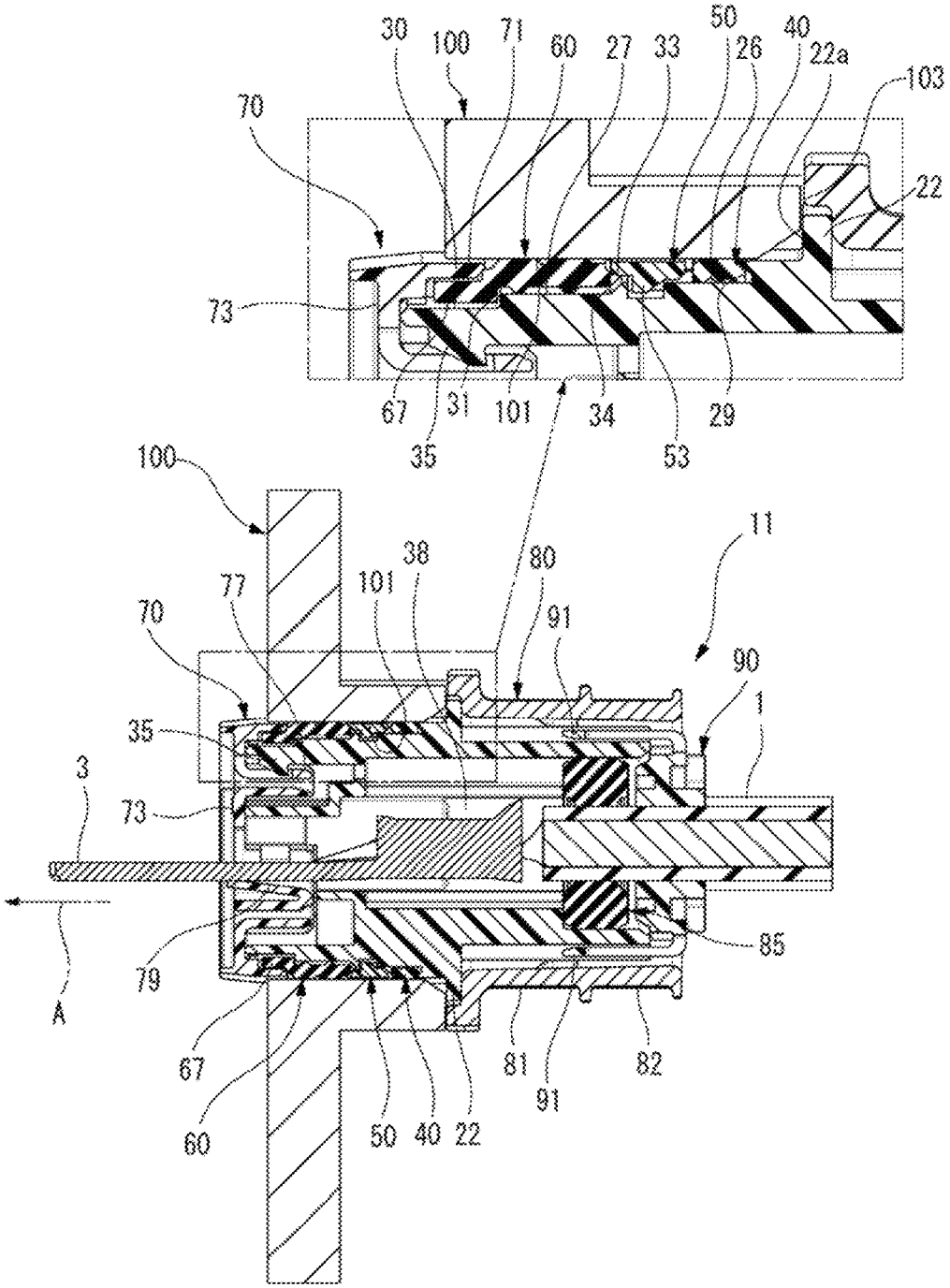
FIG. 10 is a cross-sectional arrow view taken along the line X-X in FIG. 8.

FIG. 8 is a plan view of the waterproof connector 11 illustrated in FIG. 1. FIG. 9 is a cross-sectional arrow view taken along the line IX-IX in FIG. 8. FIG. 10 is a cross-sectional arrow view taken along the line X-X in FIG. 8.

According to the waterproof connector 11 according to the present embodiment, as illustrated in FIGS. 9 and 10, the first packing 40 mounted on the first packing mounting surface 26 in the fitting portion 23 of the housing 20 is positioned and held with respect to the housing 20 by the retainer 50 locked to the locking portion 33 provided on the outer peripheral surface 21 of the fitting portion 23. Then, the first packing 40 and the second packing 60 arranged side by side on the outer peripheral surface 21 of the fitting portion 23 along the fitting direction A of the housing 20 can reliably seal a portion between the mounting hole 101 of the case body 100 and the housing 20 in a watertight manner.

Therefore, the outer peripheral surface 21 of the fitting portion 23 does not need a packing accommodation groove for positioning and holding the first packing 40 and the second packing 60. Therefore, unlike the waterproof connector of the related art, it is not necessary to expand and mount the first packing 40 on a back side in order to ride over a wall formed between a pair of packing accommodation grooves. As a result, the mounting work is facilitated and the sealing performance is not deteriorated due to the first packing 40 being twisted or the inner lip 43, which is the sealing portion of the first packing 40, being scratched during mounting.

In the waterproof connector 11 according to the present embodiment, by engaging the engaging piece 67 of the second packing 60 with the recess 30 provided on the second packing mounting surface 27 on which the second packing 60 is mounted, the second packing 60 is prevented from being displaced toward the rear end side of the housing.

In the waterproof connector 11 according to the present embodiment, the front holder 70 easily prevents the second packing 60 from being displaced toward the front end side in the fitting direction with respect to the housing 20.

In the waterproof connector 11 according to the present embodiment, the engaging piece 67 of the second packing 60 is covered by the rear end side of the annual portion 71 in the front holder 70 in the fitting direction.

Therefore, when the fitting portion 23 of the housing 20 is fitted into the mounting hole 101 of the case body 100, it is possible to prevent the second packing 60 from being turned over at the front end portion of the second packing 60 in the fitting direction.

Therefore, according to the waterproof connector 11 according to the present embodiment, it is possible to provide a waterproof connector in which it is easy to mount the packing and which has high waterproofness.

Here, the features of the above-described embodiment of the fixing structure of the shield connector according to the present disclosure are briefly summarized below.

[1] A waterproof connector (11), including:

a housing (20) having packing mounting surfaces (first packing mounting surface 26 and second packing mounting surface 27) on an outer peripheral surface (21) of a fitting portion (23) of the housing (20) to be fitted into a mounting hole (101) of a mating member (case body 100);

a first packing (40) mounted on a rear end side of the packing mounting surface (first packing mounting surface 26) in a fitting direction of the fitting portion (23);

a second packing (60) mounted on a front end side of the packing mounting surface (second packing mounting surface 27) in fitting direction of the fitting portion (23); and a retainer (50) provided between the first packing (40) and the second packing (60) and locked to a locking portion (33) provided on the outer peripheral surface (21) of the fitting portion (23).

According to the waterproof connector having the configuration of 111, the first packing mounted on the packing mounting surface in the fitting portion of the housing is positioned and held with respect to the housing by the retainer locked to the locking portion provided on the outer peripheral surface of the fitting portion. Then, the first packing and the second packing arranged side by side on the outer peripheral surface of the fitting portion along the fitting direction of the housing can reliably seal a portion between the mounting hole and the housing in a watertight manner.

Therefore, the outer peripheral surface of the fitting portion does not need a packing accommodation groove for positioning and holding the first packing and the second packing. Therefore, unlike the waterproof connector of the related art, it is not necessary to expand and mount the first packing on a back side in order to ride over a wall formed between a pair of packing accommodation grooves. As a result, the mounting work is facilitated and the sealing performance is not deteriorated due to the first packing being twisted or a sealing portion of the first packing being scratched during mounting.

[2] The waterproof connector (11) according to [1], in which, a recess (30), on which the second packing (60) is mounted, is provided on the front end side of the packing mounting surface (second packing mounting surface 27) in fitting direction; and an engaging piece (67), which is engaged with the recess (30), is provided on the front end portion of the second packing (60) in fitting direction.

According to the waterproof connector having the configuration of [2], by engaging the engaging piece of the second packing with the recess provided on the packing mounting surface on which the second packing is mounted, the second packing is prevented from being displaced toward the rear end side of the housing.

[3] The waterproof connector (11) according to [1] or [2], in which, a front holder (70), configured to hold the second packing (60), is provided in a front end portion of the housing (20) in the fitting direction.

According to the waterproof connector having the configuration of (3), the front holder easily prevents the second packing from being displaced toward the front end side in the fitting direction with respect to the housing.

[4] The waterproof connector (11) according to [3], in which, a rear end portion of the front holder (70) in the fitting direction covers at least a part (engaging piece 67) of an outer peripheral portion on the front end portion of the second packing (60) in fitting direction.

According to the waterproof connector having the configuration of (4), at least a part of (for example, the engaging piece of the second packing) the outer peripheral portion in the front end portion of the second packing in the fitting direction is covered by the rear end portion of the front holder in the fitting direction.

Therefore, when the fitting portion of the housing is fitted into the mounting hole of the mating member, it is possible to prevent the second packing from being turned over at the front end portion.

The invention is not limited to the embodiment described above and can be appropriately modified, improved, and the like. In addition, the material, shape, dimensions, number, arrangement location, and the like of each component in the embodiment described above are arbitrary and are not limited as long as the invention can be achieved.

For example, in the waterproof connector 11 according to the embodiment described above, the positioning of the first packing 40 toward the rear end side in fitting direction is performed by the step portion 29 formed between the outer peripheral surface 21 and the first packing mounting surface 26. However, the waterproof connector of the invention is not limited to this and it is also possible to position the first packing 40 toward the rear end side in fitting direction by providing a protrusion on the inner peripheral surface of the first packing and locking the protrusion to a locking recess provided on the outer peripheral surface of the fitting portion, or by engaging a locking arm provided on the inner peripheral surface of the first packing with a recess provided on the outer peripheral surface of the fitting portion.

What is claimed is:

1. A waterproof connector, comprising:

a housing having a fitting portion to be fitted into a mounting hole of a mating member, wherein a packing mounting surface is provided on an outer peripheral surface of the fitting portion;

a first packing mounted on a rear end side of the packing mounting surface in a fitting direction of the fitting portion;

a second packing mounted on a front end side of the packing mounting surface in the fitting direction of the fitting portion; and a retainer provided between the first packing and the second packing and locked to a locking portion provided on the outer peripheral surface of the fitting portion, wherein the first packing comprises a first face facing, in the fitting direction, a first side of the retainer, the second packing comprises a second face facing, in the fitting direction, a second side of the retainer, the second side of the retainer being opposite to the first side of the retainer, and the retainer is provided, in the fitting direction, entirely between the first face of the first packing and the second face of the second packing.

2. The waterproof connector according to claim 1, wherein:

a recess, on which the second packing is mounted, is provided on the front end side of the packing mounting surface in fitting direction; and an engaging piece, which is engaged with the recess, is provided on a front end portion of the second packing in the fitting direction.

3. The waterproof connector according to claim 1, wherein a front holder, configured to hold the second packing, is provided in a front end portion of the housing in the fitting direction.

4. The waterproof connector according to claim 3, wherein a rear end portion of the front holder in the fitting direction covers at least a part of an outer peripheral portion on the front end portion of the second packing in the fitting direction.

5. The waterproof connector according to claim 1, wherein in the fitting direction:

the rear end side is protruded from a flange portion of the outer peripheral surface, and the front end side of the packing mounting surface is protruded from portions of the rear end side furthest from the flange portion, and wherein the flange portion is protruded in a radial direction perpendicular to the fitting direction.

6. The waterproof connector according to claim 1, wherein the first packing and the second packing are configured to abut on the mounting hole of the mating member so as to provide a waterproof seal between the fitting portion of the housing and the mounting hole of the mating member.

* * * * *